US008858294B2

(12) United States Patent
Mimlitch, III et al.

(10) Patent No.: US 8,858,294 B2
(45) Date of Patent: Oct. 14, 2014

(54) AUTONOMOUS BOBBLE HEAD TOY

(75) Inventors: Robert H. Mimlitch, III, Rowlett, TX (US); David Anthony Norman, Greenville, TX (US); Raul Olivera, Greenville, TX (US)

(73) Assignee: Innovation First, Inc., Greenville, TX (US)

( * ) Notice: Subject to any disclaimer, the term of this patent is extended or adjusted under 35 U.S.C. 154(b) by 0 days.

(21) Appl. No.: 13/339,945

(22) Filed: Dec. 29, 2011

(65) Prior Publication Data

US 2013/0084771 A1 Apr. 4, 2013

Related U.S. Application Data

(63) Continuation of application No. 13/335,527, filed on Dec. 22, 2011.

(60) Provisional application No. 61/543,306, filed on Oct. 4, 2011.

(51) Int. Cl.

| | |
|---|---|
| ***A63H 13/00*** | (2006.01) |
| ***A63H 3/36*** | (2006.01) |
| ***A63H 11/02*** | (2006.01) |
| ***A63H 11/10*** | (2006.01) |

(52) U.S. Cl.

CPC ..... *A63H 11/10* (2013.01); *A63H 11/02* (2013.01); *A63H 13/005* (2013.01)

USPC ..... 446/351; 446/391

(58) Field of Classification Search

USPC ..... 446/3, 308–311, 351, 384, 391, 486, 446/330, 268, 440

See application file for complete search history.

(56) References Cited

U.S. PATENT DOCUMENTS

| | | | | |
|---|---|---|---|---|
| 2,398,024 | A * | 4/1946 | Martin, Jr. et al. | 446/283 |
| 3,196,580 | A * | 7/1965 | Rakestraw | 446/484 |
| 3,426,476 | A * | 2/1969 | Ayala | 446/134 |
| 3,452,473 | A * | 7/1969 | Convertine | 446/353 |
| 3,500,579 | A * | 3/1970 | Bryer | 446/462 |
| 4,103,451 | A * | 8/1978 | Kawada et al. | 446/99 |
| 4,186,516 | A * | 2/1980 | Ensmann | 446/238 |

(Continued)

FOREIGN PATENT DOCUMENTS

GB 2271940 A * 5/1994

OTHER PUBLICATIONS

Notification of Transmittal of the International Search Report and the Written Opinion of the International Searching Authority, or Declaration (1 page); International Search Report (2 pages); and Written Opinion of the International Searching Authority (11 pages), mailed Apr. 30, 2012, for related international application PCT/US2011/068091.

(Continued)

*Primary Examiner* — Gene Kim
*Assistant Examiner* — Alyssa Hylinski
(74) *Attorney, Agent, or Firm* — Adam K. Sacharoff; Much Shelist

(57) ABSTRACT

An apparatus includes a base, a drive mechanism attached to the base for causing the base to move across a support surface, a bobble head rotatably coupled to the base and rotatable about at least one axis, and a vibrating mechanism adapted to cause the bobble head to oscillate about at least one axis.

15 Claims, 3 Drawing Sheets

(56) References Cited

U.S. PATENT DOCUMENTS

| | | | | |
|---|---|---|---|---|
| 4,219,957 | A * | 9/1980 | Kakuta | 446/230 |
| 4,790,789 | A * | 12/1988 | Mathis | 446/378 |
| 5,112,265 | A * | 5/1992 | Naum | 446/384 |
| 5,176,560 | A * | 1/1993 | Wetherell et al. | 446/175 |
| 5,308,276 | A * | 5/1994 | Fogarty et al. | 446/288 |
| 5,679,047 | A * | 10/1997 | Engel | 446/3 |
| 5,890,944 | A * | 4/1999 | Wiggs et al. | 446/135 |
| 6,071,167 | A | 6/2000 | Yang | |
| 6,679,750 | B1 * | 1/2004 | Nielsen | 446/85 |
| 6,679,752 | B1 * | 1/2004 | Reed, Sr. | 446/437 |
| 6,692,332 | B2 * | 2/2004 | Jheow | 446/383 |
| D499,152 | S | 11/2004 | Kreisner | |
| 6,929,527 | B1 * | 8/2005 | Chan | 446/369 |
| 7,255,060 | B2 | 8/2007 | Grandy | |
| 7,628,672 | B2 | 12/2009 | Hoeting et al. | |
| 7,682,218 | B2 | 3/2010 | Yu et al. | |
| 7,722,431 | B2 * | 5/2010 | Sullivan et al. | 446/486 |
| 2004/0063382 | A1 | 4/2004 | Randall | |
| 2004/0198159 | A1 | 10/2004 | Xu et al. | |
| 2005/0001113 | A1 | 1/2005 | Sullivan et al. | |
| 2006/0217031 | A1 | 9/2006 | Spongberg | |
| 2007/0037476 | A1 | 2/2007 | Leslie | |
| 2007/0087654 | A1 | 4/2007 | Chernick et al. | |
| 2007/0117494 | A1 | 5/2007 | Sheller | |
| 2007/0234904 | A1 * | 10/2007 | Hoffman et al. | 96/4 |
| 2007/0264904 | A1 * | 11/2007 | Sheltman et al. | 446/440 |
| 2008/0085654 | A1 | 4/2008 | Hoeting et al. | |
| 2011/0028069 | A1 | 2/2011 | Norman et al. | |

OTHER PUBLICATIONS

Written Opinion Of the ISA on co-pending application PCT/US2011/068091; Apr. 17, 2014; Written Opinion based on ISR previously submitted.

* cited by examiner

AUTONOMOUS BOBBLE HEAD TOY

CROSS-REFERENCE TO RELATED APPLICATIONS

This application is a continuation of and claims the benefit under 35 U.S.C. §120 of U.S. patent application Ser. No. 13/335,527, filed Dec. 22, 2011, which is incorporated herein by reference in its entirety and claims the benefit under 35 U.S.C. §119(e) of U.S. patent application Ser. No. 61/543,306, entitled "Autonomous Bobble Head Toy," filed Oct. 4, 2011, which is incorporated herein by reference in its entirety.

BACKGROUND

This specification relates to devices that move based on oscillatory motion and/or vibration.

One example of vibration driven movement is a vibrating electric football game. A vibrating horizontal metal surface induced inanimate plastic figures to move randomly or slightly directionally. More recent examples of vibration driven motion use internal power sources and a vibrating mechanism located on a vehicle.

One method of creating movement-inducing vibrations is to use rotational motors that spin a shaft attached to a counterweight. The rotation of the counterweight induces an oscillatory motion. Power sources include wind up springs that are manually powered or DC electric motors. The most recent trend is to use pager motors designed to vibrate a pager or cell phone in silent mode. Vibrobots and Bristlebots are two modern examples of vehicles that use vibration to induce movement. For example, small, robotic devices, such as Vibrobots and Bristlebots, can use motors with counterweights to create vibrations. The robots' legs are generally metal wires or stiff plastic bristles. The vibration causes the entire robot to vibrate up and down as well as rotate. These robotic devices tend to drift and rotate because no significant directional control is achieved.

Vibrobots tend to use long metal wire legs. The shape and size of these vehicles vary widely and typically range from short 2" devices to tall 10" devices. Rubber feet are often added to the legs to avoid damaging tabletops and to alter the friction coefficient. Vibrobots typically have 3 or 4 legs, although designs with 10-20 exist. The vibration of the body and legs creates a motion pattern that is mostly random in direction and in rotation. Collision with walls does not result in a new direction and the result is that the wall only limits motion in that direction. The appearance of lifelike motion is very low due to the highly random motion.

Bristlebots are sometimes described in the literature as tiny directional Vibrobots. Bristlebots use hundreds of short nylon bristles for legs. The most common source of the bristles, and the vehicle body, is to use the entire head of a toothbrush. A pager motor and battery complete the typical design. Motion can be random and directionless depending on the motor and body orientation and bristle direction. Designs that use bristles angled to the rear with an attached rotating motor can achieve a general forward direction with varying amounts of turning and sideways drifting. Collisions with objects such as walls cause the vehicle to stop, then turn left or right and continue on in a general forward direction. The appearance of lifelike motion is minimal due to a gliding movement and a zombie-like reaction to hitting a wall.

SUMMARY

This specification describes technologies relating to autonomous devices that include a bobble head.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1A:
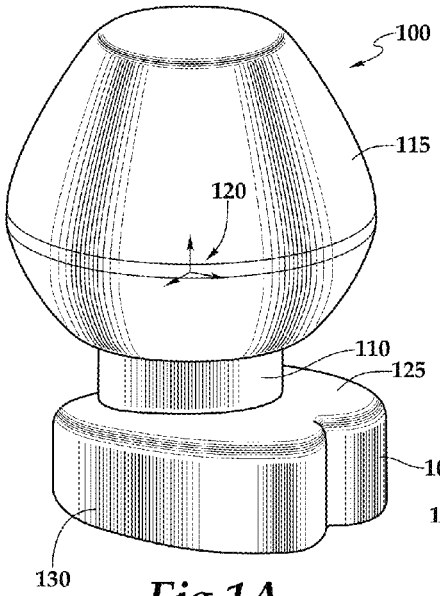
FIG. 1A depicts an upper front perspective view of an example mobile figurine device.

Autonomous figurine devices, or vibration-powered vehicles, can be designed to move across a surface, e.g., a floor, table, or other relatively smooth and/or flat surface. Such a device (e.g., made to resemble a character with a body and bobble head) can be adapted to move autonomously, turn randomly based on their design, and turn in response to external forces (e.g., by being guided by a sidewall of a game environment). In general, the devices include a base, a bobble head, one or more driving legs, and a vibrating mechanism (e.g., a motor or spring-loaded mechanical winding mechanism rotating an eccentric load, a motor or other mechanism adapted to induce oscillation of a counterweight, or other arrangement of components adapted to rapidly move the center of mass of the device). As a result of vibration induced by the vibrating mechanism, the one or more driving legs can propel the miniature device in a forward direction as the driving leg or legs contacts a support surface. The vibration can also cause movement of the bobble head giving the device an appearance of more lifelike or interesting motion. The vibration drive can also create random movement, allowing for unpredictable movement and unpredictable interaction with other objects, adding to the lifelike appearance.

Movement of the device can be induced by the motion of a rotational motor inside of, or attached to, the device, in combination with a rotating weight with a center of mass that is offset relative to the rotational axis of the motor. The rotational movement of the weight causes the motor and the device to which it is attached to vibrate. In some implementations, the rotation is approximately in the range of 6000-9000 revolutions per minute (rpm's), although higher or lower rpm values can be used. As an example, the device can use the type of vibration mechanism that exists in many pagers and cell phones that, when in vibrate mode, cause the pager or cell phone to vibrate. The vibration induced by the vibration mechanism can cause the device to move across the surface (e.g., the floor or a platform in a game environment) using one or more legs that are configured to alternately flex (in a particular direction) and return to the original position as the vibration causes the device to move up and down. For example, the device can use the type of driving mechanism (e.g., flexible/curved legs and vibration mechanism) described in U.S. patent application Ser. No. 12/872,209, entitled "Vibration Powered Toy," filed Aug. 31, 2010, and U.S. Pat. No. 8,038,503, issued Oct. 18, 2011, which are both incorporated herein by reference in its entirety.

Various features can be incorporated into the devices. For example, various implementations of the devices can include features (e.g., shape of the leg or legs, number of legs, frictional characteristics of the leg tips, relative stiffness or flexibility of the legs, resiliency of the legs, relative location of the rotating counterweight with respect to the legs, etc.) for facilitating efficient transfer of vibrations to forward motion. The speed and direction of the device's movement can depend on many factors, including the rotational speed of the motor, the size of the offset weight attached to the motor, the power supply, the characteristics (e.g., size, orientation, shape, material, resiliency, frictional characteristics, etc.) of the one or more driving legs attached to the chassis of the device, the properties of the surface on which the device operates, the overall weight of the device, and so on. The components of the device can be positioned to maintain a relatively low center of gravity (or center of mass) to discourage tipping (e.g., based on the lateral distance between the leg tips).

FIG. 1A depicts an upper front perspective view of an example mobile figurine device 100. The device 100 includes a base 105, a body 110, and a bobble head 115. In this example, the base 105 is formed to resemble or represent a large pair of feet. The small body 110 projects upwardly from the base 105 and supports the bobble head 115, which is rotatably coupled to the base such that the bobble head 115 can rotate, in an oscillating manner, about one, two or three perpendicular axes 120. The oscillation need not be periodic, nor does the bobble head 115 need to rotate to the full extent of permitted rotation with each oscillation. Instead, the oscillations may be random, or relatively random, in speed, direction, and extent of rotation. In addition, the oscillation can be induced by the vibration of the device, rather than by directly connecting the bobble head 115 to any type of drive mechanism to cause bobbling. The bobble head 115 can be a hollow shell supported from the interior. In some embodiments, the base 105, the body 110, and the bobble head 115 can be constructed from molded plastic or from some other material.

Figure 1B:
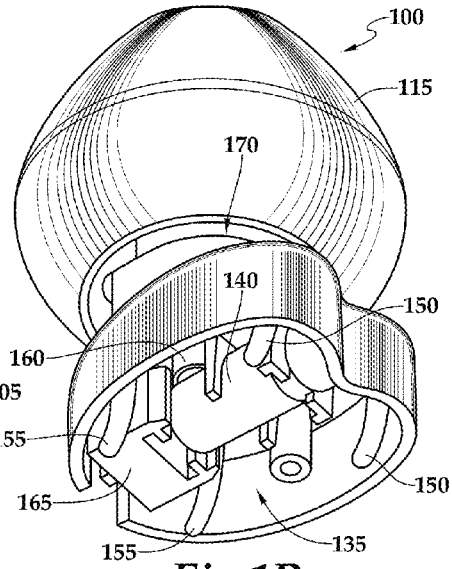
FIG. 1B depicts a lower front perspective view of the example mobile figurine device.

FIG. 1B depicts a lower front perspective view of the example mobile figurine device 100. As shown in FIGS. 1A and 1B, the base 105 can include a hollow shell having an upper surface 125 and downwardly disposed sidewalls 130 defining an inner cavity 135. The inner cavity 135 can include a rotational motor 140 attached to the base 105 for rotating an eccentric load 145 and causing the device 100 to vibrate. Such vibration can cause the bobble head 115 to rotate about one, two or three axes of rotation. In addition, in combination with a plurality of legs (e.g., one or more front driving legs 150 and, in some cases, one or more dragging legs 155) coupled to the base 105, the vibration can induce movement of the base 105, and thus the entire device 100, across a support surface. The rotational motor 140 can be activated by supplying power from a battery 160 contained within the base 105 or the body 110. Power from the battery 160 can be selectively controlled by a switch 165. The rotational motor 140 and the eccentric load 145 provide a vibration mechanism that causes the device 100 to vibrate when power is supplied to the rotational motor 140. Moreover, the vibration mechanism in combination with the legs 150 provide a drive mechanism for causing the base 105 to move across a support surface. Thus, the drive mechanism and the vibrating mechanism can be substantially contained within the inner cavity 135.

In some implementations, the size and shape of an opening 170 in a lower portion of the bobble head 115 (i.e., the portion of the bobble head 115 through which the body 110 projects into the bobble head 115 to provide rotatable support) can be configured to limit rotation of the bobble head about one or more axes of rotation. For example, the opening 170 can be sized such that forward and backward rocking of the bobble head 115 is limited (e.g., when a front or back edge of the opening 170 contacts the body 110). Similarly, side to side rocking of the bobble head 115 can be limited by the sides of the opening 170 contacting the body 110. Furthermore, rotation of the bobble head 115 (e.g., turning of the bobble head 115 about an axis perpendicular to a support surface) can be limited by using a non-circular opening 170 and non-cylindrical body 110 such that an edge of the opening 170 contacts the body 110 at a selected degree of rotation. In some cases, rotation about a particular axis may be limited more or less than rotation about axes perpendicular to the particular axis. For example, rotation of the bobble head 115 can be permitted to be up to about one-hundred twenty degrees or less, while rocking forward and back can be limited to about ninety degrees and rocking side to side can be limited to about sixty degrees. In some cases, rotation can be more limited (e.g., sixty degrees rotation, forty five degrees forward and back, and thirty degrees side to side).

Figure 2:
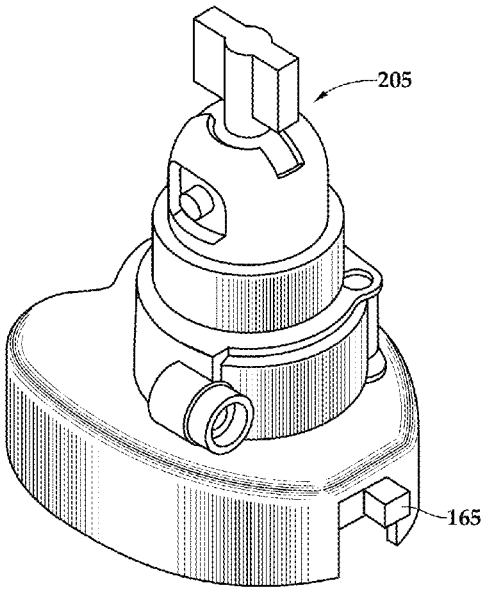
FIG. 2 depicts an upper back perspective view of the base and the body without the bobble head.

FIG. 2 depicts an upper back perspective view of the base 105 and the body 110 without the bobble head 115. As discussed above, the body 110 can project upward from the base 105. In addition, the body 110 can support a ball and socket assembly 205 that provides a rotatable coupling between the body 110 and the bobble head 115 for allowing the bobble head 115 to rotate about two or three perpendicular axes. In addition, the ball and socket assembly 205 and/or the body 110 can be designed to facilitate translation away from (e.g., through rotation or removal by lifting vertically) the base to allow access to the battery or battery door (e.g., located on the top of the base 105).

Figure 3:
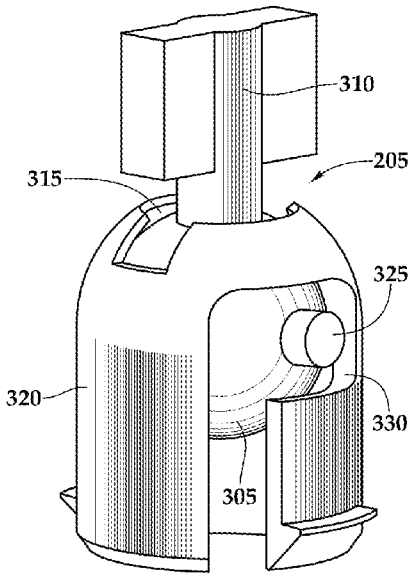
FIG. 3 depicts the ball and socket assembly in greater detail.

FIG. 3 depicts the ball and socket assembly 205 in greater detail. The ball and socket assembly 205 includes a ball 305 having a first projection 310 for attaching to the bobble head 115. The first projection 310 can project through an opening 315 in a socket component 320 to limit rotation of the first projection 310 and thus the bobble head 115 about the two perpendicular rotational axes. In particular, the generally circular opening 315 can include sufficient space to allow the first projection to move side to side, to move fore and aft, and to rotate (e.g., about an axis that runs through the first projection 310). In some cases, the opening 315 can be elongated and can allow the ball 305 to rotate farther about one axis than others. In addition, a second projection 325 on the ball 305 can also engage with a slot 330 in the socket component 320 to limit rotation of the bobble head about two perpendicular axes. The limiting features 310, 315 in combination with the limiting features 320, 325, 330 combine to cover all three perpendicular rotational axes, while overlapping on only one axis. For example, the interaction between the first projection 310 and the opening 315 and/or between the second projection 325 and the slot 330 can limit rotation of the ball 305 about a particular axis to, for example, less than about thirty degrees or less than about twenty degrees.

Figure 4A:
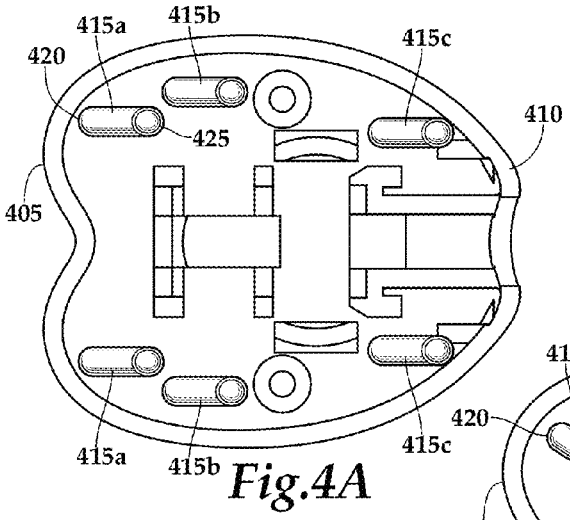
FIG. 4A depicts a bottom view of the device.

FIG. 4A depicts a bottom view of the device 100. The device 100 includes a front end 405 and a rear end 410. A plurality of legs 415 include a pair of front legs 415*a*, a pair of middle legs 415*b*, and a pair of rear legs 415*c*. A base 420 of each leg 415 is connected to the base 105 of the device 100 farther toward the front end 405 than a tip 425 of the leg 415. Each leg in the front pair of legs 415*a* is located toward a lateral side of the base 105, each leg in the middle pair of legs 415*b* is located toward a lateral side of the base 105, and each leg in the rear pair of legs 415*c* is located toward a lateral side of the base 105. The middle pair of legs 415*b* can be located closer to the front pair of legs 415*a* but spaced at a sufficient distance behind the front legs 415*a* such that both a front leg 415*a* and a middle leg 415*b* cannot fall into a hole simultaneously (e.g. on a platform that includes holes). This leg arrangement adds stability and greatly reduces the likelihood of tipping. Even in environments where holes do not exist, stability is added with the extra legs as the device 100 bounces off walls and other obstructions.

Figure 4B:
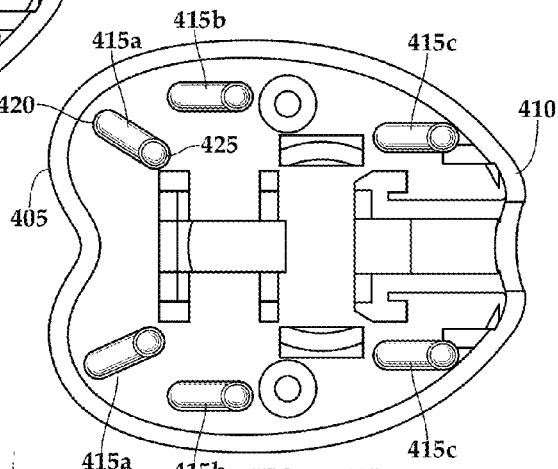
FIG. 4B depicts a bottom view of an alternative implementation of the device.

FIG. 4B depicts a bottom view of an alternative implementation of the device 100. Again, the device 100 includes a front end 405 and a rear end 410. A plurality of legs 415 include a pair of front legs 415*a*, a pair of middle legs 415*b*, and a pair of rear legs 415*c*. A base 420 of each leg 415 is connected to the base 105 of the device 100 farther toward the front end 405 than a tip 425 of the leg 415. In this implementation, however, the tips 425 of the front pair of legs 415*a* are closer to a longitudinal centerline of the device 100 than the base 420 of the front pair of legs 415*a*. By pointing the front two legs 415*a* inward, the device 100 can more easily turn away from walls and corners with relatively minimal impact on forward speed.

Figure 5:
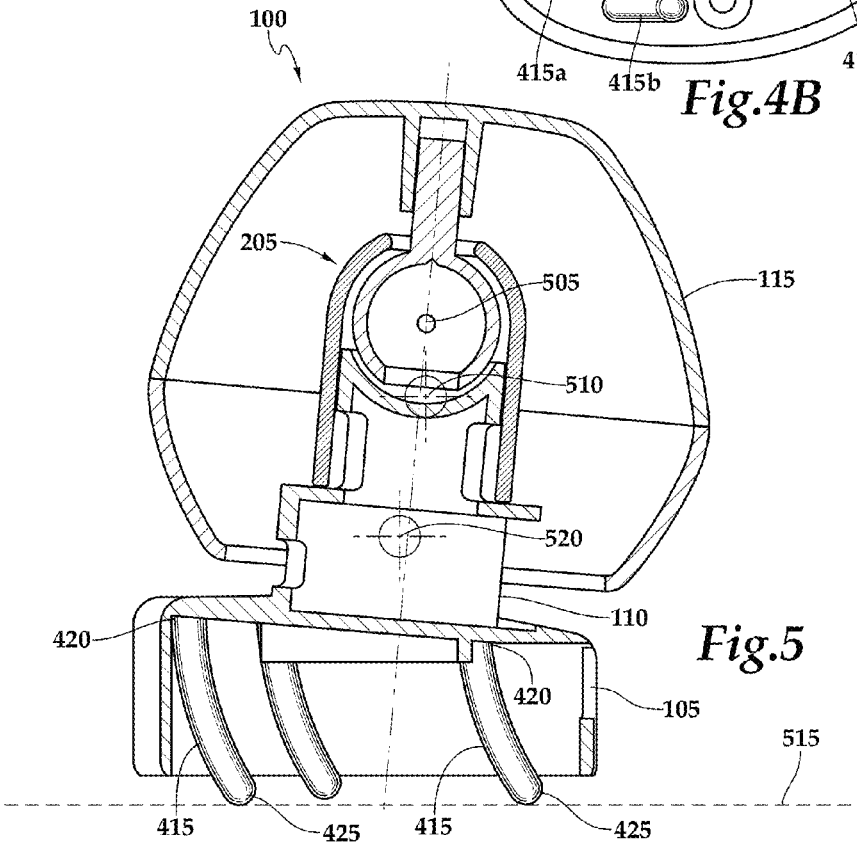
FIG. 5 depicts a cross-sectional side view of the device.

FIG. 5 depicts a cross-sectional side view of the device 100. As shown in FIG. 5, the ball and socket assembly 205 includes a pivot point 505 located above a center of gravity 510 of the bobble head 115. For purposes of determining the center of gravity 510, for example, the bobble head 115 can include the ball 305, the first projection 310, the second projection 325, and any other components that are fixedly attached to the bobble head 115. In general, the pivot point 505 can be located sufficiently above the center of gravity 510 of the bobble head 115 such that the bobble head 115 maintains a substantially neutral position (i.e., balanced and/or not leaning in any particular direction) when the device 100 is stationary (i.e., not moving and/or vibrating). The placement of the pivot point 505 above the center of gravity 510 can be altered to change the behavior of the bobble head 115. As the pivot point 505 and the center of gravity 510 approach each other, for example, the bobble action increases as the influence of gravity is reduced. Controlling the bobble action movement can be achieved by adjusting the position of the pivot point 505 above the center of gravity 510. The location of the center of gravity 510 can be selected to maintain a desired neutral position of the bobble head 115. For example, the center of gravity 510 can be positioned to cause the bobble head 115 to tend toward a neutral position where the bobble head 115 is leaning toward a rear of the device, as illustrated in FIG. 5. Thus, the bobble head 115 can be biased to a neutral position with respect to at least two axes of rotation. In some cases, the bobble head 115 can be biased to a neutral position with respect to three axes of rotation (e.g., to cause the bobble head 115 to tend toward a neutral forward-facing position).

Also as shown in FIG. 5, the body 110 can be tilted toward a rear end of the base 105. The tilt can be introduced, for example, by a tilt in the upper surface 125 of the base 105. The body 110 on which the ball and socket assembly 205 rests can be tilted back a small amount such that the pivot point 505 is behind the center of the base 105. This tilt moves the overall device center of gravity 520 towards the back legs 415*c* to facilitate easier turning and more lively action. The tilt also allows for a neutral head position so that the bobble head 115 faces slightly upward in front so the face is more easily viewed. Random movement can be facilitated by a sufficiently high center of gravity 520 along with the tilted back body 110 and bobble head 115, which moves the center of gravity 520 closer to the rear legs 415*c*.

Each of the plurality of legs 415 includes a leg base 420 and a leg tip 425 at a distal end relative to the leg base 420. The legs 415 are coupled to the base 105 at the leg base 420 and include one or more driving legs (e.g., front legs 415*a*) constructed from a flexible material and configured to cause the apparatus to move in a direction generally defined by an offset between the leg base 420 and the leg tip 425 as the rotational motor rotates the eccentric load. In some implementations, the driving leg(s) 415 are curved in the rearward direction. Alternatively, the driving leg(s) 415 can be generally straight but may still include an offset between the leg base 420 and the leg tip 425. In addition, the driving leg(s) 415 can be constructed from relatively inflexible materials, such as stiff plastic, or from bristles.

In some implementations, the middle pair of legs 415*b* are shorter than the front and rear pairs of legs 415*a* and 415*c* (i.e., the middle legs 415*b* extend a shorter distance downward from the base 105 than a plane 515 defined by the leg tips 425 of the front pair of legs 415*a* and the leg tips 425 of the rear pair of legs 415*c*). For example, the middle legs 415*b* can be about 0.3 mm above the plane 515 so the middle legs 415*b* only touch when needed to add stability, and thus do not interfere with the propulsion action of the front legs 415*a*.

In addition, a center of gravity 520 of the apparatus can be located closer to the rear pair of legs 415*c* than the front pair of legs 415*a*, which can help produce higher front leg jumps and an increased turning angle, including an improved ability to turn when encountering a wall or other obstruction.

In some implementations, a distance between each leg in the front pair of legs 415*a* is greater than 50% of a distance between the front pair of legs 415*a* and the rear pair of legs 415*c*. A relatively shorter length from front leg to rear leg improves turning.

The base 105 projects farther forward than the bobble head 115 when the device 100 is in an upright position. This configuration helps ensure that collisions with obstacles tend to occur at the base 105, instead of the bobble head 115.

In some implementations, the components and weight distribution of the device 100 can be selected to impact functionality. For example, the rotational motor 140 can be positioned toward a front end 405 of the device 100 to increase the vibration excitation on the front legs 415*a* which provide the primary drive for the device 100. The rotational motor 140 can rotate an eccentric load located farther toward the front end 405 of the device 100. The axis of rotation of the rotational motor 140 can be generally aligned with a direction of movement of the device 100 (e.g., the general direction that the device 100 tends to move on average when on a flat and level surface). The battery (e.g., an AG13 coin battery located horizontally just above the base 105) can be placed toward the rear end 410 of the device 100 and low in the device 100 to lighten the load over the front legs 415*a* and reduce the angular moment of inertia.

In some implementations, a linear vibration motor can be used. In these applications the motor would be aligned to create vibration normal to the driving surface. The vibration axis could alternately be tilted forward slightly to increase forward driving force. This type of vibration is sufficient to create movement and induce the bobble effect. The downside of this implementation is the lack of vibration in the direction perpendicular to the movement direction. The side-to-side vibration helps to create the random movement that improves lifelike motion.

In some implementations, a cutoff switch can be used to remove power to the rotational motor when the device 100 tips over (i.e., tips away from an upright position). Since tipping will eventually occur, it is undesireable to a human-like figurine to have an appearance of flailing helplessly on the ground without an ability to get up. A tilt-based cutoff switch that removes power from the motor when the device has tipped over can help avoid this result. Generally, the tilt sensor can be sufficiently damped so the sensor does not intermittently cut power due to vibration.

As an alternative to driving legs, the drive mechanism can include one or more wheels adapted to rotate under power of a motor. The vibration mechanism in such a case can include a plurality of wheels having at least one of different vertical positions, different circumferences, or different circumferential shapes for inducing vibration by creating instability in movement. Vibration can also be induced by varying acceleration of the bobble head figure, which can be achieved by accelerating and decelerating a drive mechanism attached to the bobble head figure or multiple drive mechanisms (e.g., located on the right and left sides of the bobble head figure, or as a result of collisions with objects.

Figure 6:
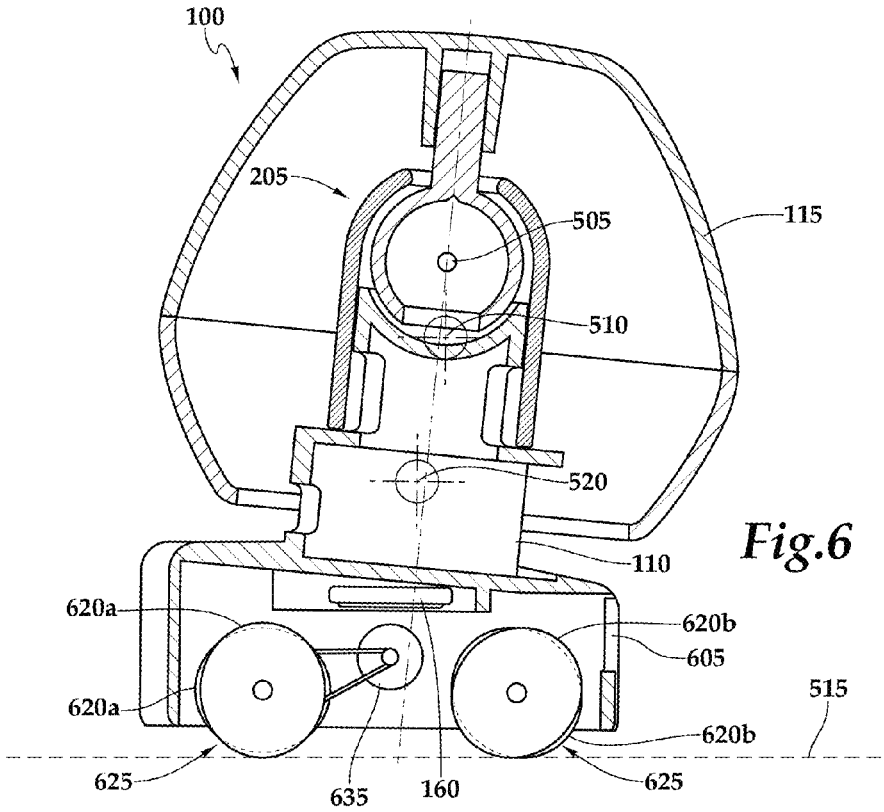
FIG. 6 is depicts an alternative mobile figurine device.

FIG. 6 is depicts an alternative mobile figurine device 600. The device 600 includes a base 605, a body 610, and a bobble head 615. The small body 610 projects upwardly from the base 605 and supports the bobble head 615, which is rotatably coupled to the base such that the bobble head 615 can rotate about one, two or three perpendicular axes 630. The bobble head 615 can be a hollow shell supported from the interior. In some embodiments, the base 605, the body 610, and the bobble head 615 can be constructed from molded plastic or from some other material. Instead of legs, the device 600 includes a plurality of wheels 620, including a pair of front wheels 620*a* and a pair of rear wheels 620*b*. One or more of the wheels 620 can propel the device 600 through a connection (e.g., gears, belts, etc.) to a rotational motor 635. The wheels can have an elongated circumferential shape and each wheel 620 can be aligned such that the elongated portions are not aligned (as indicated at 625), which can induce vibration as the device 600 rolls across a surface. Different wheels 620 can also have different circumferences (e.g., front wheels 620*a* can have a different circumference than rear wheels 620*b*) to introduce randomness of vibration and movement. Alternative embodiments can include cylindrical wheels with protrusions or bumps that cause the device 600 to vibrate. More than two pairs of wheels can also be used. For example, a larger pair of middle wheels can be used to introduce fore and aft instability, which can also help induce vibration.

Figure 7:
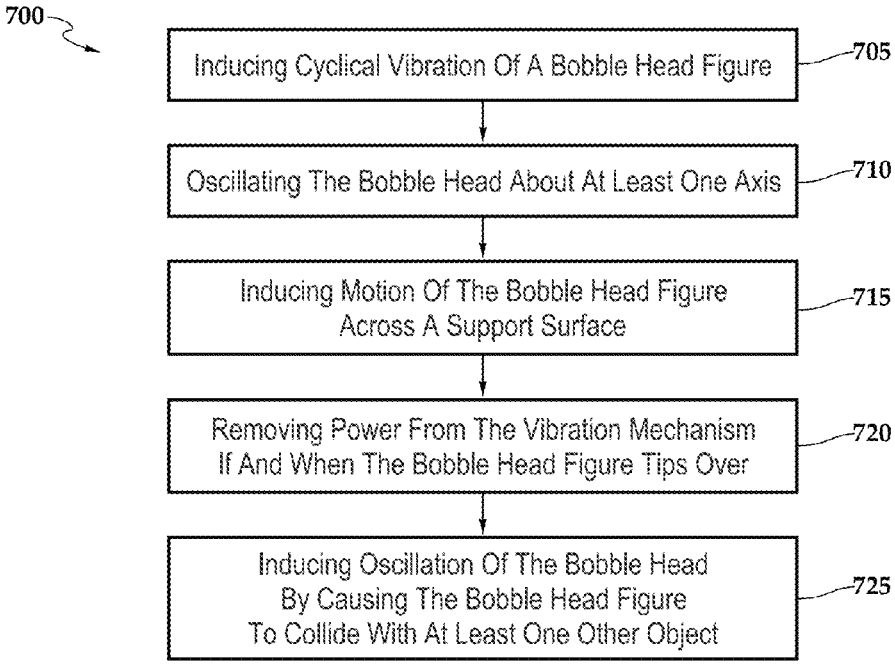
FIG. 7 is a flow diagram of a method of inducing bobbling in a bobble head figure.

FIG. 7 is a flow diagram of a method 700 of inducing bobbling in a bobble head figure. Cyclical vibration of a bobble head figure is induced at 705. The bobble head figure can include a base and a bobble head rotatably coupled to the base. Cyclical vibration of the bobble head figure can be induced by rotating an eccentric load using a rotational motor. Alternatively, linear vibration or vibration caused by varying acceleration of the bobble head figure can be used. The bobble head can be adapted to oscillate about at least one axis at 710 as a result of the cyclical vibration. Motion of the bobble head figure across a support surface can also be induced at 715. The motion can be induced by rotation of the rotational motor. For example, the cyclical vibration can cause one or more driving legs to propel the bobble head figure across the support surface. Alternatively, the rotational motor can drive a wheel that causes the bobble head figure to move across the support surface. Power can be removed from the rotational motor if and when the bobble head figure tips over at 720. Oscillation of the bobble head about the at least one axis can further be induced by causing the bobble head figure to collide with at least one other object at 725 as the bobble head figure moves across the support surface. While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination. Moreover, the separation of various system components in the embodiments described above should not be understood as requiring such separation in all embodiments.

Thus, particular embodiments of the subject matter have been described. Other embodiments are within the scope of the following claims.

What is claimed is:

1. An apparatus comprising:

a base;

a vibrating mechanism attached to the base;

a drive mechanism attached to the base for causing the base to move across a support surface, wherein the drive mechanism includes at least one driving leg having a leg base and a leg tip at a distal end relative to the leg base, wherein the at least one driving leg is coupled to the base at the leg base and constructed from a flexible material and configured to cause the apparatus to move in a forward direction generally defined by an offset between the leg base and the leg tip as a result of vibration induced by the vibrating mechanism;

a ball and socket assembly coupled to the base, the ball and socket assembly including a ball having a first projection extending substantially upwardly through a first slot defined about an upper portion of a socket, and the ball further having a second projection extending substantially outwardly through a second slot defined about a side portion of the socket such that movement of the ball within the socket is limited when the first and second projections contact the first and second slots; and a bobble head coupled to the first projection, wherein the vibrating mechanism is adapted to cause the bobble head to oscillate about at least one axis and the vibrating mechanism is further adapted to cause the apparatus to move in the forward direction.

2. The apparatus of claim 1, wherein the ball and socket assembly facilitates oscillation of the bobble head about three perpendicular axes.

3. The apparatus of claim 1, wherein the ball and socket assembly limits the rotation of the bobble head about at least one axis to less than about one hundred twenty degrees.

4. The apparatus of claim 1, wherein the ball and socket assembly define a pivot point located above a center of gravity of the bobble head, wherein the pivot point is located sufficiently above the center of gravity of the bobble head such that the bobble head maintains a substantially neutral position when the apparatus is stationary.

5. The apparatus of claim 1, wherein the vibrating mechanism and the drive mechanism are both powered by linear vibration in at least one axis.

6. The apparatus of claim 1, wherein the vibrating mechanism and the drive mechanism are both powered by an eccentric load, wherein a rotational motor is adapted to rotate the eccentric load.

7. The apparatus of claim 6 wherein the drive mechanism includes a plurality of legs each having a leg base and a leg tip at a distal end relative to the leg base, wherein the legs are coupled to the base at the leg base and include the at least one driving leg constructed from a flexible material and configured to cause the apparatus to move in a direction generally defined by an offset between the leg base and the leg tip as the rotational motor rotates the eccentric load.

8. The apparatus of claim 7, wherein the plurality of legs include a front pair of legs and a rear pair of legs, with each leg in the front pair of legs located toward a lateral side of the base and each leg in the rear pair of legs located toward a lateral side of the base.

9. The apparatus of claim 8, wherein the plurality of legs further include at least one additional pair of legs located farther toward the rear of the base than the front pair of legs and farther toward the front of the base than the rear pair of legs, with each leg in the additional pair of legs located toward a lateral side of the base.

10. The apparatus of claim 8, herein the leg tip of each leg in the front pair of legs is located closer to a longitudinal centerline of the base than the leg base of each leg in the front pair of legs.

11. The apparatus of claim 9, wherein the additional pair of legs extend a shorter distance downward from the base than a plane defined by the leg tips of the front pair of legs and the leg tips of the rear pair of legs.

12. The apparatus of claim 8, wherein a center of gravity of the apparatus is located closer to the rear pair of legs than the front pair of legs.

13. The apparatus of claim 8, wherein a distance between each leg in the front pair of legs is greater than 50% of a distance between the front pair of legs and the rear pair of legs.

14. The apparatus of claim 1, further comprising a cutoff switch adapted to remove power to the rotational motor when the apparatus tips away from an upright position.

15. The apparatus of claim 1, wherein the base projects farther forward than the bobble head when the apparatus is in an upright position.

* * * * *